United States Patent [19]

Simonovich et al.

[11] 4,384,756

[45] May 24, 1983

[54] ELECTRICAL OPTION SWITCH

[75] Inventors: Lambert Simonovich, Kanata; Roger A. Beun, Dunrobin, both of Canada

[73] Assignee: Northern Telecom Limited, Montreal, Canada

[21] Appl. No.: 273,669

[22] Filed: Jun. 15, 1981

[51] Int. Cl.[3] ..... H01R 13/00

[52] U.S. Cl. ..... 339/32 R

[58] Field of Search ..... 339/32 R, 32 M, 33

[56] References Cited

U.S. PATENT DOCUMENTS

| | | | |
|---|---|---|---|
| 2,256,181 | 9/1941 | Tyrner | 339/32 M X |
| 3,231,767 | 1/1966 | Powell | 339/32 M X |
| 3,629,789 | 12/1971 | Szeremy | 339/33 |
| 3,980,368 | 9/1976 | Fremont | 339/32 M X |

FOREIGN PATENT DOCUMENTS

| | | | |
|---|---|---|---|
| 1503482 | 10/1967 | France | 339/32 M |
| 324007 | 1/1930 | United Kingdom | 339/32 M |

*Primary Examiner*—Howard N. Goldberg
*Attorney, Agent, or Firm*—John E. Mowle

[57] ABSTRACT

An electrical plug-in option switch in which the orientation of the female plug while withdrawn from the associated male jack may be altered to select different circuit options. The plug is constrained by a supporting flange so that its orientation can be altered only when it is fully withdrawn from the jack. In addition contact between the plug and jack is possible only when the pins and sockets are aligned thereby preventing inadvertent damage to the pins during selection of the electrical option.

5 Claims, 4 Drawing Figures

ELECTRICAL OPTION SWITCH

This invention relates to an option switch and more particularly to one which may be utilized in conjunction with a plug-in circuit board to provide a through or loop power option.

BACKGROUND OF THE INVENTION

In cable transmission systems, it is common practice to connect the power serially to the repeater amplifiers and to loop the power back at an intermediate position in the system. With this arrangement, it is necessary to provide a switch so that either the through power or loop power option may be selected at the repeater site. Of necessity, such a switch must be rugged, low cost, substantially foolproof and yet readily altered to select the option preferably without removal of any protective cover or other part.

STATEMENT OF THE INVENTION

The present invention provides an improved option switch for an electrical circuit board and the like which finds particular application in a repeater amplifier. The option switch comprises a male jack having a plurality of symmetrically disposed conductive pins which project orthogonally from a surface of the board. In addition, a bracket disposed over the board has a symmetrically-sided guide hole centered over the projecting pins. The switch also includes a female plug having a symmetrically-sided body portion slidably fitted into the guide hole to mate with the jack in a plurality of orientations. The body portion of the plug has a flange at one end to prevent withdrawal thereof from the guide hole, which is connected by a neck that allows axial rotation of the plug only when the neck is positioned in the guide hole. The plug also includes selectively interconnected conductive sockets aligned with the conductive pins so as to transfer current between pairs of pins when the plug and jack are mated in at least one of the plurality of orientations.

In a particular embodiment, the jack has four conductive pins and both the guide hole and body portion of the plug are square in shape. The four conductive sockets in the plug are paired together so that orthogonal switch options may be selected.

BRIEF DESCRIPTION OF THE DRAWINGS

An example of an embodiment of the invention will now be described with reference to the accompanying drawings in which.

DESCRIPTION OF THE PREFERRED EMBODIMENT

Figure 1:
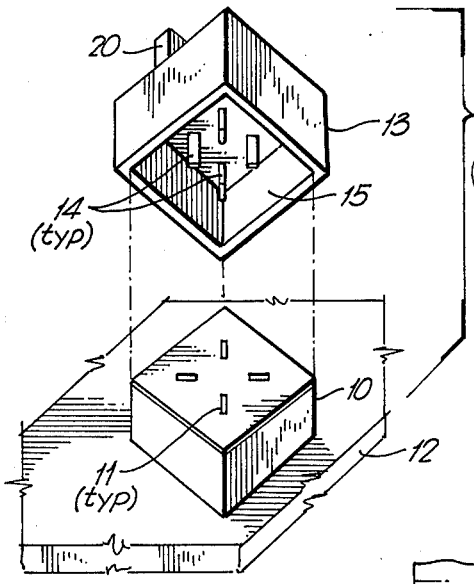
Fig. 1 (PRIOR ART)
FIG. 1 is an isometric exploded view of a prior art option switch.

Referring to FIG. 1, the prior art option switch comprises a square shaped female jack 10 having four electrical sockets 11, which typically is mounted on a printed circuit board 12. In addition, the switch includes a male plug 13 hving four equi-spaced pins 14 aligned with the sockets 11 in the jack 10. The plug 13 has a square shaped recess 15 which slidably fits over the square shaped jack 10. This is an essential feature of this prior art switch and prevents damage to the pins 14 should an attempt be made to insert the plug 13 in a non-aligned jack 10. Pairs of pins 14 are electrically interconnected so that a through or loop power option may be selected by rotating the plug 13. This is achieved by grasping and lifting the plug 13 by its flat sided stem 20 and reinserting it at an orthogonal angle. It will be evident that identical connections will be made by reversing the plug 13 as there is identical interconnection between the two pairs of pins 14. The orientation of the plug 13 is evident from the stem 20. Either a protective cover (not shown) or other device could act to retain the plug 13. However, when the cover is removed for servicing, the plug 13 is vulnerable to misplacement and possible loss should it be removed for any reason. A hole in the cover can be provided so that the orientation of the plug 13 can be altered without removing the cover.

Figure 4:
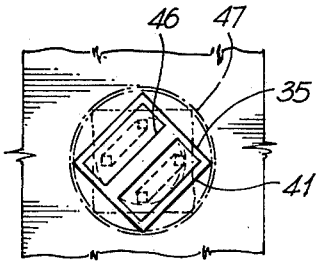
FIG. 4 is a top view of the option switch illustrated in FIG. 2.
Figure 3:
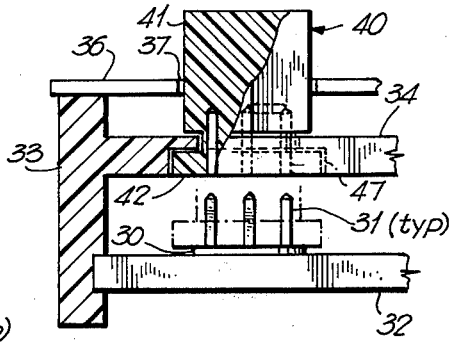
FIG. 3 is a cross-sectional view of the option switch illustrated in FIG. 2.
Figure 2:
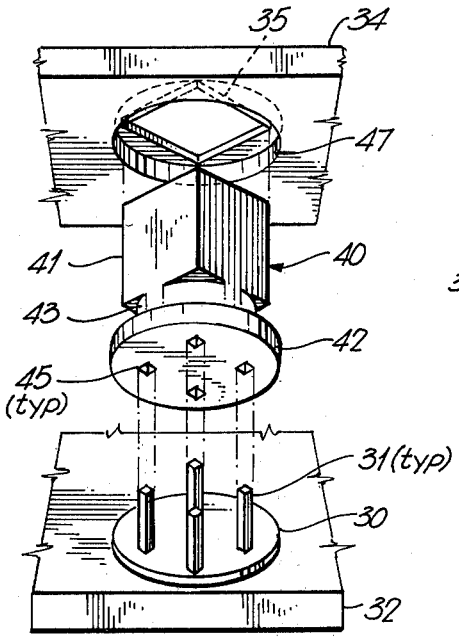
FIG. 2 is an isometric exploded view of an option switch in accordance with the present invention.

Referring to FIGS. 2, 3 and 4, the option switch of the present invention comprises a male jack 30 having four equi-spaced conductive pins 31, mounted on a printed (i.e. electrical) circuit board 32. A flange 33 which is used to support a protective cover 36, is mounted on one end of the board 32 and has a bracket 34 extending therefrom. The bracket 34 has a square guide hole 35 centered over the pins 31.

The option switch also includes a female plug 40 which has a square body portin 41 that slidably fits into the guide hole 35. At the end of the body portion 41 facing the pins 31 is a circular flange 42 which prevents withdrawal of the plug 40 through the hole 35. Connected between the body portion 41 and the flange 42 is a circular neck 43 which has a diameter equal to the width of the hole 35 thereby allowing axial rotation of the plug 40 as shown in the broken outline of FIG. 4, only when the neck is positioned in the guide hole 35. This has the important effect that the plug 40 cannot be inadvertently mated with the jack 30 when misaligned thereby avoiding damage to the pins 31.

The plug 40 also includes four conductive sockets 45 which are aligned with the four pins 31. The four sockets 45 are paired and each pair is interconnected as shown in FIG. 4 to allow current transfer therebetween. The end of the plug 40 remote from the flange 42 is recessed and has a partition wall 46 thereacross which may be used to indicate the orientation of the plug 40.

To change from a through power to a loop power option, a pair of needlenosed pliers are used to grasp the plug 40 by the partition wall 46, withdraw it until the neck 43 is positioned in the guide hole 35 at which time the plug 40 may be freely rotated orthogonally to its original orientation and then reinserted to mate with the jack 30. To reduce play between the two parts during this procedure, the underside of the bracket 34 has an undercut circular portion 47 into which the circular flange 42 slidably fits. Optionally this may be done without removing the protective cover 36 by providing a hole 37 therein, centered over the plug 40. However, unlike the prior art switch of FIG. 1, the removable portion of the switch cannot become misplaced when the protective cover 36 is removed for servicing. Once assembled, the plug 40 is retained between the bracket 34 and the circuit board 32.

In addition to providing a power option, the switch could be readily used in other applications such as where filter or balance network options are required.

What is claimed is:

1. An option switch for an electrical circuit board or the like, comprising:

a jack having a plurality of symmetrically disposed conductive pins projecting orthogonally from a surface of the board;

a bracket disposed over the board, having a symmetrically-sided guide hole centered over the projecting pins;

a plug having a symmetrically-sided body portion slidably fitted in the guide hole to mate with the jack in a plurality of orientations, the body portion having a flange at one end to prevent withdrawal thereof from the guide hole, which is connected by a neck that allows axial rotation of the plug only when the neck is positioned in the guide hole; and the plug includes selectively interconnected conductive sockets aligned with the conductive pins so as to transfer current between pairs of pins when the plug and connector are mated in at least one of said orientations.

2. An option switch for an electrical circuit board and the like, comprising:

a jack having a plurality of conductive pins symmetrically disposed about two axes and projecting orthogonally from a surface of the board;

a bracket on the board, having a square guide hole centered over the projecting pins;

a plug having a square body portion slideably fitted in the guide hole, the body portion having a flange at one end to prevent withdrawal thereof from the guide hole, which is connected by a neck that allows axial rotation of the plug only when the neck is positioned in the guide hole;

the plug including selectively interconnected conductive sockets aligned with the conductive pins so as to transfer current between pairs of pins when the plug and jack are mated.

3. An option switch as defined in claim 2 in which:

there is a flange at one end of the circuit board, and the bracket projects from said flange.

4. An option switch as defined in claim 2 in which:

there are four conductive pins, and four conductive sockets which are paired together; and the other end of the square body portion is recessed and includes a partition wall which indicates the orientation of the plug relative to the jack.

5. An option switch as defined in claim 2 in which:

the neck is circular in cross-section, and has a diameter which is about equal to the width of the square body portion; and the flange is circular and the underside of the bracket is circularly undercut to receive the flange.

* * * * *